United States Patent [19]

Manos

[11] 4,332,737

[45] Jun. 1, 1982

[54] ACID REACTION PRODUCTS OF POLYMERIC AMINES

[75] Inventor: Philip Manos, Wilmington, Del.

[73] Assignee: E. I. Du Pont de Nemours and Company, Wilmington, Del.

[21] Appl. No.: 141,662

[22] Filed: Apr. 18, 1980

[51] Int. Cl.[3] ..... C09F 5/00

[52] U.S. Cl. ..... 260/404.5; 260/97.5; 44/66

[58] Field of Search ..... 260/404.5 PA, 97.5; 44/66

[56] References Cited

U.S. PATENT DOCUMENTS

| | | | |
|---|---|---|---|
| 2,568,876 | 9/1951 | White | 260/404.5 |
| 3,148,960 | 9/1964 | Becker | 44/66 X |
| 3,216,936 | 11/1965 | Le Suer | 260/404.5 |
| 3,468,639 | 9/1969 | Lindstrom | 44/66 |
| 3,655,351 | 4/1972 | Jamieson | 44/66 |
| 3,765,850 | 10/1973 | Badin | 44/66 |
| 3,894,849 | 7/1975 | Polss | 44/66 |

*Primary Examiner*—John F. Niebling
*Attorney, Agent, or Firm*—F. J. Crowley

[57] ABSTRACT

Composition useful as hydrocarbon fuel additives of the formula

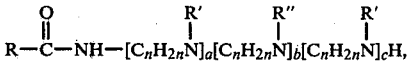

wherein R is a $C_{9-23}$hydrocarbyl group, R′ is selected from H and

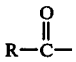

and wherein at least one R′ is H, R″ is

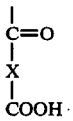

group where X is a divalent hydrocarbyl group of 2 to 34 carbon atoms, n is an integer of 2 or 3 or a combination of 2 and 3, a is an integer of 0–3, b is an integer of 1–2, c is an integer of 0–3 and a+b+c is 2–8.

7 Claims, No Drawings

ACID REACTION PRODUCTS OF POLYMERIC AMINES

FIELD OF THE INVENTION

This invention relates to new compositions of matter which are useful as additives for hydrocarbon fuels. When incorporated into a hydrocarbon fuel, these compositions provide detergency action and also function as corrosion inhibitors. They are particularly useful in gasoline fuels.

BACKGROUND OF THE INVENTION

Rough idling and stalling of gasoline engines can be caused by an accumulation of deposits in the throttle body section of the carburetor where the deposits interfere with normal air flow and cause the fuel-air mixture to be excessively rich. It is generally recognized that the sources of deposits are contaminants in the intake air which come from dust and other particulate matter in the atmosphere as well as engine blowby.

One of the means for dealing with the problem of carburetor deposits and the consequent stalling or rough idling of the engine is the use of fuels containing additives which function as carburetor detergents and prevent build-up of deposits on the throttle plate and other parts of the carburetor. In addition to carburetor detergency, fuels must possess other properties which are provided by the use of additives. One of the most important of these is anti-rust protection of surfaces that are in contact with the fuel. The transportation and storage of fuel almost inevitably results in some water finding its way into the fuel. Condensation of water vapor in the atmosphere inside storage tanks is a very common source of water in fuels. For this reason, it is common practice to add to fuels materials which protect metal surfaces against corrosion. It is an object of the present invention to provide additive compositions for hydrocarbon fuels which are effective both as carburetor detergents and as corrosion inhibitors.

SUMMARY OF THE INVENTION

The present invention provides new compositions of matter useful as additives for hydrocarbon fuels. These compositions have the following chemical formula:

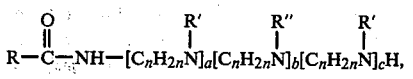

$$R-\overset{O}{\overset{\|}{C}}-NH-[C_nH_{2n}\overset{R'}{\overset{|}{N}}]_a[C_nH_{2n}\overset{R''}{\overset{|}{N}}]_b[C_nH_{2n}\overset{R'}{\overset{|}{N}}]_cH,$$

wherein

R is a $C_{9-23}$hydrocarbyl group,

R′ is selected from H and

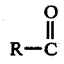

$$R-\overset{O}{\overset{\|}{C}}$$

and wherein at least one R′ is H,

R″ is

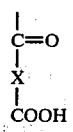

$$\begin{array}{c} | \\ C{=}O \\ | \\ X \\ | \\ COOH \end{array}$$

group where X is a divalent hydrocarbyl group of 2 to 34 carbon atoms, n is an integer of 2 or 3 or a combination of 2 and 3, a is an integer of 0–3, b is an integer of 1–2, c is an integer of 0–3 and a+b+c is 2–8.

In essence, the compositions of the present invention are acylated alkylenepolyamines wherein at least one acyl is an acyl group of a $C_{10}$ to $C_{24}$ aliphatic monocarboxylic acid, at least one acyl group is a monoacyl group of a $C_4$ to $C_{36}$ dicarboxylic acid, the total number of acyl groups being one less than the number of nitrogen atoms in the alkylenepolyamine molecule. A preferred class of compounds are those in which only one of the R′ groups is hydrogen. In other words, for the purpose of using the compositions as a fuel additive, it is preferable to have acyl groups at all of the R′ sites except one.

DETAILED DESCRIPTION OF THE INVENTION

The compositions of the present invention can be readily prepared by reacting an alkylenepolyamine containing at least three amino groups with an aliphatic monocarboxylic acid to form a carboxylic amide which is then reacted with a dicarboxylic acid or acid anhydride to provide an amic acid derivative of the dicarboxylic acid. The amount of monocarboxylic acid and dicarboxylic acid used is such that at least one amino group of the alkylenepolyamine remains unacylated. These reactions can be illustrated by the following general chemical equations where the symbols have the same meaning as in the foregoing structural formula.

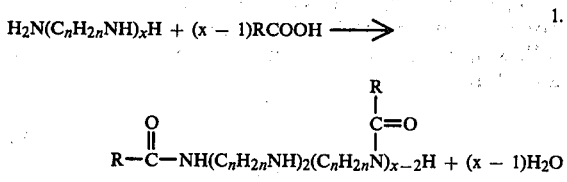

$$H_2N(C_nH_{2n}NH)_xH + (x-1)RCOOH \longrightarrow R-\overset{O}{\overset{\|}{C}}-NH(C_nH_{2n}NH)_2(C_nH_{2n}\overset{R}{\overset{|}{N}})_{x-2}H + (x-1)H_2O \quad 1.$$

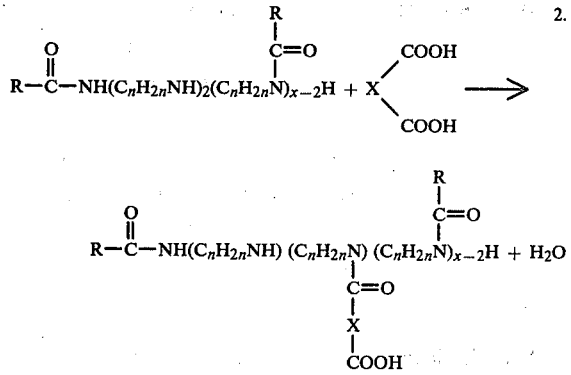

$$R-\overset{O}{\overset{\|}{C}}-NH(C_nH_{2n}NH)_2(C_nH_{2n}\overset{R}{\overset{|}{N}})_{x-2}H + X\begin{matrix}COOH\\COOH\end{matrix} \longrightarrow R-\overset{O}{\overset{\|}{C}}-NH(C_nH_{2n}NH)(C_nH_{2n}\overset{R}{\overset{|}{N}})(C_nH_{2n}\overset{R}{\overset{|}{N}})_{x-2}H + H_2O \quad 2.$$

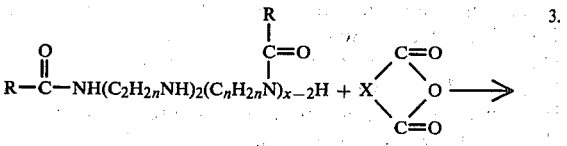

$$R-\overset{O}{\overset{\|}{C}}-NH(C_2H_{2n}NH)_2(C_nH_{2n}\overset{R}{\overset{|}{N}})_{x-2}H + X\begin{matrix}C{=}O\\ \diagup\ \diagdown\\ O\\ \diagdown\ \diagup\\ C{=}O\end{matrix} \longrightarrow \quad 3.$$

-continued

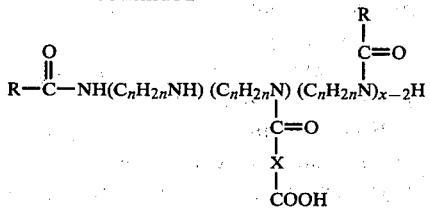

In terms of a specific reaction, the following equations illustrate the preparation of tetraethylenepentamine tristearoyl monomaleamic acid by reacting tetraethylenepentamine with stearic acid and then with maleic acid.

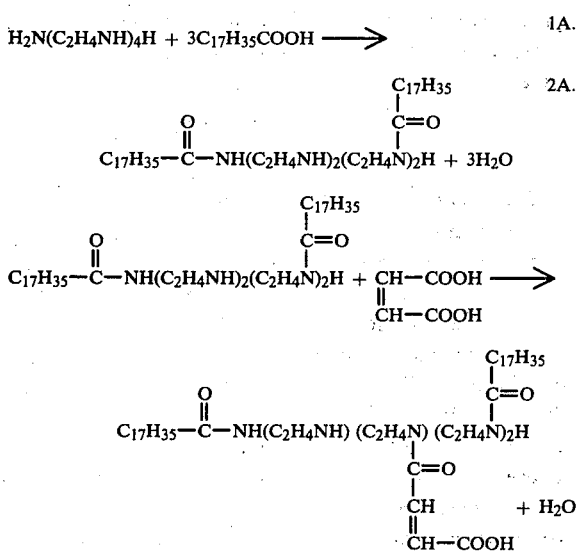

As mentioned above, it is also possible to use the dicarboxylic acid anhydride to form the amic acid, and the following equation shows such a reaction using maleic anhydride.

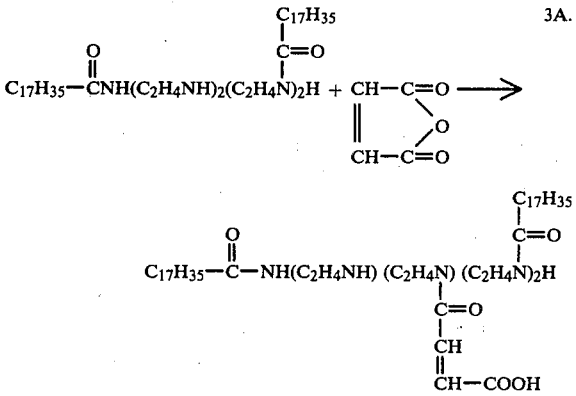

The alkylenepolyamines which are useful for the preparation of the acylated polyamines of the present invention can be represented by the formula $H_2N(C_nH_{2n}NH)_xH$ where n is 2 or 3 and x is 2 to 8. The alkylenepolyamines and their preparation are well-known in the art. Most of the alkylenepolyamines useful in the present compositions are commercially available. Representative alkylenepolyamines are diethylenetriamine, triethylenetetramine, tetraethylenepentamine, pentaethylenehexamine, hexaethyleneheptamine, dipropylenetriamine, tripropylenetetramine, tetrapropylenepentamine, pentapropylenehexamine and the like. Commercially available alkylenepolyamines which are mixtures of alkylenepolyamine homologues can also be used. Preferred are polyethylenepolyamines because of their greater availability.

Alkylenepolyamines containing both ethylene and propylene groups are also useful in the present invention. Such mixed-alkylenepolyamines can be readily prepared by condensing ethylenediamine with one molar proportion of acrylonitrile to form N-cyanoethylethylenediamine which can then be reduced, e.g. by catalytic hydrogenation to form a mixed-alkylenepolyamine represented by $H_2NCH_2CH_2NHCH_2CH_2CH_2NH_2$.

The monocarboxylic acid used to acylate the alkylenepolyamine is an aliphatic hydrocarbon carboxylic acid of 10–24 carbon atoms; it can be saturated or unsaturated, straight-chain or branched-chain. Included are alkanoic, alkenoic and alkadienoic acids. Representative carboxylic acids include decanoic, decenoic, dodecanoic, dodecenoic, tridecanoic, tridecenoic, tetradecanoic, tetradecenoic, hexadecanoic, hexadecenoic, octadecanoic, phenylstearic, octadecenoic, octadecadienoic, eicosanoic, uneicosanoic and doeicosanoic acids. Mixed acids can be employed. Acid mixtures such as those obtained by hydrolysis of natural fats and oils are useful. Included are those derived from coconut oil, corn oil, cottonseed oil, tallow and soybean oil. The acids prepared from tallow are ordinarily mixtures of tetradecanoic, tetradecenoic, hexadecanoic, hexadecenoic, octadecanoic, octadecenoic, octadecadienoic and eicosanoic acids; those prepared from soybean oil are mixtures containing hexadecanoic, octadecanoic, octadecadienoic and eicosanoic acids; those prepared from cottonseed oil are mixtures ordinarily containing tetradecanoic, hexadecanoic, octadecanoic, octadecadienoic and eicosanoic acids; and those prepared from coconut oil contain decanoic, dodecanoic, tetradecanoic, hexadecanoic, octadecanoic, octadecenoic and octadecatrienoic acids with a very small amount of octanoic acid. A useful acid mixture is tall oil fatty acid obtained from tall oil. Tall oil is a mixture of rosin acids and fatty acids obtained upon acidulation of the black liquor soap skimmed off the black liquor from the sulfate process for the manufacture of Kraft paper. Crude tall oil is commonly fractionally distilled to provide various cuts wherein the ratio of fatty acids to rosin acids varies from 1:99 to 99:1. In the context of this description, tall oil fatty acid is intended to include tall oil compositions having a fatty acid content of at least about 50% by weight, the balance being mainly rosin acids in admixture with minor amounts of unsaponifiable materials of unknown chemical composition. The fatty acids in tall oil fatty acids consist mainly of oleic, linoleic, conjugated linoleic, palmitic, stearic, palmitoleic, arachidic and behenic acids. Tall oil fatty acids which are commercially available include those with the following compositions: palmitic (0.1–5.3%); palmitoleic (0.1–2.1%); stearic (2.1–2.6%); oleic (39.3–49.5%); linoleic (38.1–41.4%); eicosanoic (1.2–1.9%); eicosadienoic (0.5–3.2%); eicosatrienoic (0.4–2.9%); and behenic (0.4–0.9%) acids, with the balance being rosin acids, unidentified acids and unsaponifiable materials.

Since the present invention composition, as defined, contains at least one nitrogen atom free of acyl group and at least one acyl group derived from dicarboxylic acid, the amount of monocarboxylic acid used relative to the alkylenepolyamine should be such that at least two nitrogen atoms of the alkylenepolyamine remain unacylated, that is the number of moles of monocarboxylic acid used per mole of alkylenepolyamine should be at least two less than the number of nitrogen atoms in the alkylenepolyamine.

Obviously, instead of the monocarboxylic acid, an acid halide or an anhydride of the acid can be used to prepare the acylated polyamine, however, because of the lower cost and availability, the carboxylic acid is preferred.

With the monocarboxylic acid as the acylating reactant, the preferred method is to react the carboxylic acid and the polyamine at 80° C.–200° C. in the absence of any solvent and to remove no more than about one mole of condensation water for each mole of the acid reacted. As is known, under certain reaction conditions, when a carboxylic acid is reacted with an alkylenepolyamine, particularly ethylenepolyamine or a propylenepolyamine, a cyclization reaction involving the primary amino group, its adjacent amino group and the carboxylic acid can take place to form nitrogen-containing cyclic compounds which are imidazoline derivatives (when an ethylenepolyamine is used) or tetrahydropyrimidine derivatives (when a propylenepolyamine is used). It is preferred to keep the formation of the above-described nitrogen-containing cyclic compounds to a minimum. The above-described acylation procedure assures minimal formation of the nitrogen-containing cyclic compounds.

The alkylenepolyamine acylated with monocarboxylic acid is then reacted with a dicarboxylic acid in such a manner that the product obtained is an amic acid, that is, a product wherein only one of the two carboxylic acid groups is reacted to form an amide, the other carboxylic acid group remaining as a free carboxyl group. Usually one molar proportion of the dicarboxylic acid is reacted with the acylated polyamine. Useful dicarboxylic acids are those containing from about 4 to about 36 carbon atoms and include, inter alia, maleic, fumaric, succinic, alkyl or alkenylsuccinic, citraconic, glutaric, adipic, dimer acid producted by dimerization of $C_{16-18}$unsaturated monocarboxylic fatty acids as well as aryldicarboxylic acids such as phthalic acid, terephthalic acid, naphthalene dicarboxylic acid and the like. Preferred are dicarboxylic acids which are readily available as anhydrides such as maleic anhydride, citraconic anhydride, succinic anhydride, alkyl or alkenylsuccinic anhydride, and phthalic anhydride since the reaction to produce the amic acid with the acylated polyamine and the anhydride proceeds almost spontaneously at room temperature or with very little heating. When a dicarboxylic acid is used to react with the acylated polyamine, sufficient heating, usually in the range of about 80° C. to about 120° C., is used for the amic acid formation and the heating is continued until about one mole of water of condensation per mole of the dicarboxylic acid used is removed. Prolonged reaction with the evolution of more than about one mole of water of condensation should be avoided since such reaction conditions can lead to the formation of diamides or imides of the dicarboxylic acid, which products are not as effective as a corrosion inhibitor as the amic acids. While hydrocarbyl dicarboxylic acid is preferred, it should be clear that the hydrocarbyl dicarboxylic acid may contain substituents such as halogen, cyano, nitro, hydroxyl, additional carboxyl groups which do not interfere with the performance of the present composition. The compositions of this invention can be readily characterized by well-known techniques such a infra-red spectroscopy and acid number determinations.

The amic acids of the present invention are useful as anti-corrosion inhibitors for hydrocarbon fuels which include automobile gasolines, aviation gasolines, jet fuels, kerosines, diesel fuels and fuel oils. They are particularly useful in gasolines providing the multi-functional benefits of antirust protection and carburetor detergency. The gasoline containing the present composition may also contain conventional additives such as antiknock compounds, antioxidants, metal deactivators, corrosion inhibitors, anti-icing agents, dehaze agents, detergents and the like. Generally, to obtain the benefits of its multifunctional properties, the present inventin composition is incorporated into gasoline at a concentration of from about 0.0002 to 0.02 percent by weight (0.5 to 50 pounds per thousand barrels, ptb), preferably from about 0.0004 to 0.004 percent by weight (1 to 10 ptb). Concentrations higher than about 0.02 percent by weight can be used but do not appear to provide further benefits. Amounts within the above specified ranges are also recommended for fuels other than gasoline.

The compositions of the invention can be added to the hydrocarbon fuels by any means known in the art for incorporating small quantities of additives to hydrocarbon fuels. Present composition can also be added to the hydrocarbon fuels as a part of any other additive package which is added to the fuels. It is convenient to prepare the present compositions as concentrates, that is as concentrated solutions in suitable solvents. When used as a concentrate, the additive composition will contain about 35% to 85% by weight of the present composition and about 65% to 15% by weight of a solvent, preferably from about 60% to 80% by weight of the composition and from about 20% to 40% by weight of the solvent. Suitable solvents are normally liquid organic compounds boiling in the hydrocarbon fuel boiling range, particularly hydrocarbons and alcohols and include hexane, cyclohexane, heptane, octane, isooctane, benzene, toluene, xylene, methanol, ethanol, propanol, butanol, gasolines, jet fuels and the like. Mixtures of solvents can also be used. The preferred solvent is xylene.

EXAMPLE 1

A. Preparation of Tetraethylenepentamine Tall Oil Fatty Acid Triamide

Tetraethylenepentamine tall oil fatty acid triamide is a commercial product prepared from commercial tetraethylenepentamine and three molar proportion of carboxylic acid functionality of a commercial tall oil fatty acid mixture containing primarily oleic and linoleic acids (about 78%), with palmitic, palmitoleic, stearic, eicosodienoic and eicosotrienoic acids present in minor proportions, by a process essentially as described at column 6, lines 35–62 of U.S. Pat. No. 3,894,849.

B. Preparation of Tetraethylenepentamine Tall Oil Fatty Acid Triamide Monophthaloamic Acid In a 125 ml reaction flask equipped with a thermometer and a stirrer, 9.8 g (0.01 mole) triamide prepared as in A above and 1.48 g (0.01 mole) phthalic anhydride were stirred and heated at 80° C. for one hour. Sufficient xylene was added to provide 50% solution of tetraethylenepentamine tall oil fatty acid triamide monophthaloamic acid in xylene. The resulting product had an acid number of 32 (determined by electrometric titration) and analysis by infrared spectroscopy showed an amide band at 1640–1650 $cm^{-1}$, and a carboxylic acid band at 1720 $cm^{-1}$.

C. Preparation of Tetraethylenepentamine Tall Oil Fatty Acid Triamide Monomaleoamic Acid In a 125 ml reaction flask equipped with a thermometer and a stirrer, 10 g triamide prepared as in A above and 1 g maleic anhydride were stirred and heated at 80° C. for 1 hour. The resulting product had an acid number of 33 (determined by electrometric titration) and analysis by infrared spectroscopy showed an amide band at 1640–1650 $cm^{-1}$, and a carboxylic acid band at 1720 $cm^{-1}$.

EXAMPLE 2

A. Preparation of Tetraethylenepentamine Tris(isostearoylamide)

Into a 500 ml reaction flask equipped with a thermometer, a stirrer and a distillation head, 38 g (0.2 mole) tetraethylenepentamine and 170.4 g (0.6 mole) isostearic acid were placed. The mixture was stirred and heated under reduced pressure at 140°–150° C. until the evolution of condensation water ceased, which took about 1.5 hours. The product, tetraethylenepentamine tris(isostearoylamide) is an amber color liquid.

B. Preparation of Tetraethylenepentamine Tris(isostearoylamide)monomaleamic Acid Into a 125 ml reaction flask equipped with a thermometer and a stirrer were placed 24.7 g (0.025 mole) tetraethylenepentamine tris(isostearoylamide) (prepared in A above) and 27 g xylene. The mixture was stirred to obtain a homogeneous solution. To the solution, 2.3 g (0.025 mole) maleic anhydride was added. The mixture was heated at 90° C. for two hours. There being no weight loss, the monomaleamic acid was obtained as a 50% solution in xylene. Electrometric titration gave an acid number of 29. Examination by infrared spectroscopy showed an amide band at 1640–1650 $cm^{-1}$ and a carboxylic acid band at 1720 $cm^{-1}$.

C. Preparation of Tetraethylenepentamine Tris(isostearoylamide)monophthaloamic Acid Into a 125 ml reaction flask equipped with a stirrer and a thermometer were placed 24.7 g (0.025 mole) tetraethylenepentamine tris(stearoylamide) (prepared in A above) and 28.4 g xylene. The mixture was stirred to dissolve the triamide. To the solution, 3.7 g (0.025 mole) phthalic anhydride was added and the mixture was heated at 90° C. for 2 hours. The product is tetraethylenepentamine tris(isostearoylamide)monophthaloylamic acid obtained as a 50% solution in xylene. Electrometric titration gave an acid number of 30. Examination by infrared spectroscopy showed an amide band at 1640–1650 $cm^{-1}$ and a carboxylic acid band at 1720 $cm^{-1}$.

EXAMPLE 3

A. Preparation of Tetraethylenepentamine Tris(phenylstearoylamide)

Into a 300 ml reaction flask equipped with a thermometer, an agitator and an addition funnel, 6 g (0.03 mole) tetraethylenepentamine was added and heated to 70°–75° C. with agitation. From the addition funnel, 32.4 g (0.09 mole) phenylstearic acid was added over 10 minutes. To insure complete addition of phenylstearic acid, 15–20 ml hexane was added to the addition funnel and thence into the reaction mixture after hexane was allowed to evaporate away, the contents of the flask was placed under reduced pressure and heated to 175° C. with agitation. Heating was continued at 175° C. for 2 hours allowing the condensation water to distill off. The product, tetraethylenepentamine tris(phenylstearoylamide) was viscous, amber colored liquid.

B. Preparation of Tetraethylenepentamine Tris(phenylstearoylamide)monomaleamic Acid In a 125 ml reaction flask equipped with an agitator and a thermometer, 12.6 g (0.01 mole) tetraethylenepentamine tris(phenylstearoylamide) prepared in A above and 1 g (0.01 mole) maleic anhydride were heated at 80° C. for 30 minutes. The reaction mixture became more viscous so 13.6 g xylene was added and heating continued for an additional 30 minutes. The product was obtained as 50% solution in xylene. The product had an acid number of 33 as determined by electrometric titration. Examination by infrared spectroscopy showed an amide band at 1640–1650 $cm^{-1}$ and a carboxylic acid band at 1720 $cm^{-1}$.

C. Preparation of Tetraethylenepentamine Tris(phenylstearoylamide)monophthaloamic Acid In a 125 ml reaction flask equipped with an agitator and a thermometer, 12.6 (0.01 mole) tetraethylenepentamine tris(phenylstearoylamide) prepared as in A above and 1.48 g (0.01 mole) phthalic anhydride was heated at 80° C. with agitation until essentially all of solids disappeared (about 1 hour). Xylene 14.1 g was added to provide 50% solution of the product in xylene. The product had an acid number of 30 as determined by electrometric titration. Examination by infrared spectroscopy showed an amide band at 1640–1650 $cm^{-1}$ and a carboxylic acid band at 1720 $cm^{-1}$.

EXAMPLE 4

A carburetor keep-clean test (Onan) is carried out in a single-cylinder engine to which a controlled amount of exhaust gas from another engine is mixed with the air supplied to the test carburetor. The test carburetor is provided with a two-piece stainless steel liner fitted around the throttle plate shaft. The liner is easily removed for inspection and rating. The engine is operated under cycling conditions of one minute idling and three minutes of part-throttle until an overall test period of two hours is achieved. The liner is visually rated on a scale of 0–10, the visual rating of 10 being given for a clean carburetor, 0 for a very dirty carburetor. The results are tabulated in Table 1.

TABLE 1

| Additive (0.002 wt %, 5 ptb) | Onan Rating |
|---|---|
| None (control fuel) | 4.5 |
| Example 1-A (comparison) | 7.2 |
| Example 1-C | 7.8 |

TABLE 1-continued

| Additive (0.002 wt %, 5 ptb) | Onan Rating |
|---|---|
| Example 3-A (comparison) | 8.1 |
| Example 3-B | 8.0 |

The above results show that the compounds of the invention are very effective in keeping carburetors clean at very low treating levels. Generally, a rating of at least 7 is desired for very effective carburetor detergency. Thus, it is evident that the present compounds are effective carburetor detergents.

EXAMPLE 5

The ability of a gasoline containing a composition of the present invention in keeping the throttle body area of the carburetor clean was determined in a multicylinder engine according to CRC (Coordinating Research Council), "Tentative Research Technique for the Study of Carburetor Cleanliness Characteristics of Gasoline" (Mar. 1, 1978). In this procedure a 6-cylinder engine is cycled between idle (700 rpm) and medium cruise speed (2,000 rpm) for a total of 20 hours. A controlled amount of blowby, induced by enlarging the gaps of the compression rings, is passed into the top of the carburetor. Also full EGR (Exhaust Gas Recirculation) is applied during the cruise condition. The performance of the gasoline is judged by the amount of deposits formed on the removable throttle body sleeve as determined by the weight of the deposit present and by visual rating. In the present test, visual ratings were on the basis of 0 to 10 where 10 represents clean throttle sleeve and 0 represents very dirty throttle sleeve. The fuel used was Phillips J Reference Fuel (Phillips Petroleum Company, Bartesville, Okla.). To insure that the test results obtained with the present composition were valid, the test with the fuel containing the present composition was preceded by two control runs (reference fuel only) and then followed by two control runs.

TABLE 2

| CRC Carburetor Cleanliness Test Fuel: Phillips J Reference | | |
|---|---|---|
| Additive (Conc.) | Visual Rating (10 = Clean) | Deposit Weight (mg) |
| None | 6.6 | 6.3 |
| None | 6.5 | 7.6 |
| Example 2-B Composition (0.0008%, 2 ptb) | 7.4 | 2.5 |
| None | 6.4 | 7.5 |
| None | 6.2 | 7.8 |

The above results show that the compositions of the invention were effective in keeping carburetors clean.

EXAMPLE 6

The effectiveness of the present compositions as corrosion inhibitors for hydrocarbon fuels was determined according to NACE (National Association of Corrosion Engineers) Standard TM-01-72, "Antirust Properties of Petroleum Pipeline Cargoes." The test method is essentially the ASTM D665 method modified to determine antirust properties of gasolines and distillate fuels in movement through product pipelines. The method involves stirring a mixture of the test fuel and distilled water for 4 hours at 38° C. with a cylindrical steel specimen immersed in the mixture. The antirust rating is based on the portion of the steel test specimen exposed within the test fluid and is expressed using the following rating scale:

| Rating | Proportion of Test Surface Rusted |
|---|---|
| A | None |
| B++ | Less than 0.1% (2 or 3 spots of no more than 1 mm diameter) |
| B+ | Less than 5% |
| B | 5 to 25% |
| C | 25 to 50% |
| D | 50 to 75% |
| E | 75 to 100% |

Ordinarily a rating of B+ or B++ is adequate to control corrosion in active pipelines although a rating of A is obviously more desirable.

The results with the present compositions are summarized in Table 3. For comparison purposes, results with the precursors of the present composition, i.e. polyalkylenepolyamine acylated with monocarboxylic acid, are also summarized in the table.

TABLE 3

| NACE Corrosion Tests | Rating and (% of Surface Rusted) Concentration | | |
|---|---|---|---|
| Additive | 0.0002% (0.5 ptb) | 0.0008% (2 ptb) | 0.002% (5 ptb) |
| Example 1-A (Comparison) | D(70) | D(60) | B(10) |
| Example 1-B | B(10) | A(0) | A(0) |
| Example 1-C | B+(3) | B+(1) | A(0) |
| Example 2-A (Comparison) | E(85) | B(20) | B(15) |
| Example 2-B | B+(0.5) | B++(<0.1) | A(0) |
| Example 2-C | B+(0.2) | B+(3) | B++(<0.1) |
| Example 3-A (Comparison) | E(85) | E(80) | B(20) |
| Example 3-B | C(40) | A(0) | A(0) |
| Example 3-C | B+(0.5) | A(0) | A(0) |

The above results show that the compositions of the invention are effective corrosion inhibitors at low concentrations. Generally, at concentrations of 0.0008% (2 ptb), the compositions provide acceptable corrosion protection (B+ or better).

I claim:

1. A composition of matter having the chemical formula:

$$R-\overset{\overset{\displaystyle O}{\|}}{C}-NH-[C_nH_{2n}\overset{\overset{\displaystyle R'}{|}}{N}]_a[C_nH_{2n}\overset{\overset{\displaystyle R''}{|}}{N}]_b[C_nH_{2n}\overset{\overset{\displaystyle R'}{|}}{N}]_cH,$$

wherein

R is a $C_{9-23}$hydrocarbyl group,

R′ is selected from H and $$R-\overset{\overset{\displaystyle O}{\|}}{C}-$$

and wherein at least one R′ is H,

R″ is

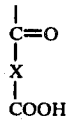

group where X is a divalent hydrocarbyl group of 2 to 34 carbon atoms, n is an integer of 2 or 3 or a combination of 2 and 3, a is an integer of 0–3, b is an integer of 1–2, c is an integer of 0–3 and a+b+c is 2–8.

2. The composition of claim 1 in which only one of the R′ groups is hydrogen.

3. The composition of claim 1 which is tetraethylenepentamine tall oil fatty acid triamide monomaleoamic acid.

4. The composition of claim 1 which is tetraethylenepentamine tris(isosteroylamide)monophthaloamic acid.

5. The composition of claim 1 which is tetraethylenepentamine tris(phenylstearoylamide)monophthaloamic acid.

6. The composition of claim 1 which is tetraethylenepentamine tall oil fatty acid triamide monophthaloamic acid.

7. The composition of claim 1 which is tetraethylenepentamine tris(isostearoylamide)monomaleamic acid.

* * * * *